United States Patent [19]

Smith et al.

[11] 4,106,895

[45] Aug. 15, 1978

[54] DYE TRANSFERRING METHOD

[75] Inventors: Geoffrey Allan Smith, Melrose; Alan James Laidlaw, Galashiels, both of Scotland

[73] Assignee: Fastran AG, Zug, Switzerland

[21] Appl. No.: 667,319

[22] Filed: Mar. 16, 1976

[51] Int. Cl.[2] ..... D06P 3/16; D06P 3/06

[52] U.S. Cl. ..... 8/2.5 A; 8/54; 8/92

[58] Field of Search ..... 8/2.5 R, 2.5 A, 92, 8/93, 54, 86, 43; 427/150, 151, 301, 323

[56] References Cited

U.S. PATENT DOCUMENTS

| | | | |
|---|---|---|---|
| 1,799,754 | 4/1931 | Lawrence | 8/2.5 |
| 1,827,591 | 10/1931 | Lawrence | 8/2.5 UX |
| 2,196,885 | 4/1940 | Wyler | 8/86 X |
| 2,228,483 | 1/1941 | Raecke | 8/86 X |

FOREIGN PATENT DOCUMENTS 1,284,824 8/1972 United Kingdom.

*Primary Examiner*—William A. Powell
*Assistant Examiner*—Thomas Bokan
*Attorney, Agent, or Firm*—Fidelman, Wolffe & Waldron

[57] ABSTRACT

For the transference of dyes from paper onto textile fabrics, using a heated press at a temperature between 80° to 120° C at a pressure of up to 10 lbs. per square inch, and for a period not exceeding 10 minutes, whereafter the printed fabric or material is removed from the press, washed and dried, it is proposed to preliminarily treat the textile fabric with a padding material comprised of citric acid and/or potassium hydrogen sulphate and a printing paste thickener.

3 Claims, No Drawings

DYE TRANSFERRING METHOD

This invention relates to a method of transferring dyes from paper onto textile fabrics and represents an improvement in or modification of a preferred mode of performance of the method disclosed in our British Pat. No. 1,284,824.

According to that Patent there was proposed a method of transferring dyes which comprised transferring coloured dyes from a paper roll onto a padded textile fabric or material of animal fibres, using a heated press at a temperature between 80° to 120° C at a pressure of up to 10 lbs. per square inch, and for a period not exceeding 10 minutes, the printed fabric or material being then removed from the press, washed in water and dried.

The padding on the textile fabric preferably comprised sulphamic acid as an aqueous acidic liquid phase and a printing paste thickener which is stable under acid conditions, for example a locust bean derivative.

It has however now been discovered that the padding medium may instead comprise citric acid and/or potassium hydrogen sulphate as an alternative to sulphamic acid.

When used together the preferred ratio between citric acid and potassium hydrogen sulphate will normally be in the range 3:2 to 2:3 with a preferred ratio of 1:1.

The preferred mode of procedure is as described in specification 1,284,824 and the following is an example of a padding medium supplied as a powder.

EXAMPLE:

Diaprint Reg, an etherized locust kernel flour, a special thickening agent for acetate, silk, synthetics, and wool, a Diamalt product: 10 parts Citric Acid and/or Potassium Hydrogen Sulphate: 1 – 3 parts To prepare for use, mix 4.4 parts powder with 95.6 parts water at 60°– 80° C. Cool to room temperature and evenly impregnate the fabric with this paste in the proportion of 2.5 parts to 1 part of fabric.

We claim:

1. A method of transferring dyes which comprises transferring coloured dyes from a paper roll onto a textile fabric or material of animal fibres which has been padded with a composition selected from the group consisting of potassium hydrogen sulfate and mixture of potassium hydrogen sulphate and citric acid in the ratio of 3:2 to 2:3 and a printing paste thickener which is stable under acid conditions, using a heated press at a temperature between 80° and 120° C at a pressure of up to 10 lbs. per square inch, and for a period not exceeding 10 minutes, the printed fabric or material being then removed from the press washed in water and dried.

2. A method as claimed in claim 1 in which the composition contains citric acid and potassium hydrogen sulphate in the ratio range 3:2 to 2:3.

3. A method as claimed in claim 1 in which the composition contains citric acid and potassium hydrogen sulphate in the ratio 1:1.

* * * * *